US008662304B2

(12) United States Patent
Myszak

(10) Patent No.: US 8,662,304 B2
(45) Date of Patent: Mar. 4, 2014

(54) PHARMACEUTICAL PACKAGE HAVING A TWISTABLE ACTUATOR AND ASSOCIATED METHOD OF ACCESSING MEDICATION

(75) Inventor: Nicholas R. Myszak, Memphis, TN (US)

(73) Assignee: McKesson Corporation, San Francisco, CA (US)

( * ) Notice: Subject to any disclaimer, the term of this patent is extended or adjusted under 35 U.S.C. 154(b) by 149 days.

(21) Appl. No.: 12/953,515

(22) Filed: Nov. 24, 2010

(65) Prior Publication Data

US 2012/0125805 A1 May 24, 2012

(51) Int. Cl.
*B65D 83/04* (2006.01)
*A61J 1/03* (2006.01)

(52) U.S. Cl.
USPC ..... 206/531; 206/528; 206/493

(58) Field of Classification Search
USPC ..... 206/536, 538, 531, 534.1, 472, 39.2, 206/39.4, 829, 493, 37.5, 528; 220/DIG. 34
See application file for complete search history.

(56) References Cited

U.S. PATENT DOCUMENTS

| | | | | |
|---|---|---|---|---|
| 1,130,629 | A * | 3/1915 | Prouty | 206/39.2 |
| 4,192,422 | A * | 3/1980 | Kotyuk | 206/528 |
| 5,802,890 | A * | 9/1998 | Espada-Velasco | 70/57.1 |
| 5,878,887 | A * | 3/1999 | Parker et al. | 206/528 |
| 5,882,052 | A * | 3/1999 | Whitehead | 292/80 |
| 6,098,835 | A * | 8/2000 | DeJonge | 221/25 |
| 7,464,819 | B2 * | 12/2008 | Maietta | 206/536 |
| 7,588,149 | B2 * | 9/2009 | Gelardi | 206/531 |
| 7,654,388 | B2 * | 2/2010 | Catron | 206/1.5 |
| 8,066,122 | B2 * | 11/2011 | Beecroft et al. | 206/536 |
| 2003/0102321 | A1 * | 6/2003 | Maietta | 220/824 |
| 2008/0190801 | A1 * | 8/2008 | Kwok | 206/459.1 |
| 2009/0184022 | A1 * | 7/2009 | Coe et al. | 206/531 |
| 2010/0038278 | A1 * | 2/2010 | Gattefosse et al. | 206/531 |
| 2010/0300923 | A1 * | 12/2010 | Sack et al. | 206/531 |

OTHER PUBLICATIONS

Burgopak compliance packaging: Bespoke innovative package design; Stand out in a competitive market; [Online]; [Retrieved on Feb. 23, 2011]; Retrieved from the Internet <URL: http://www.burgopakhealthcare.com/index.php>; 2 pages.

Burgopak compliance packaging: Packs; Innovative Pharmaceutical Packs; [Online]; [Retrieved on Feb. 24, 2011]; Retrieved from the Internet <URL: http://www.burgopakhealthcare.com/packs.html>; 3 pages.

(Continued)

*Primary Examiner* — Andrew Perreault
*Assistant Examiner* — Mollie Llewellyn
(74) *Attorney, Agent, or Firm* — Alston & Bird LLP

(57) ABSTRACT

A pharmaceutical package and an associated method are provided that is child resistant, but that may be readily accessible for users having arthritis or otherwise having limited mobility in their fingers. The pharmaceutical package includes a housing and a card carrying medication that is slidably disposed at least partially within the housing such that the at least one medication is positioned within the housing. The pharmaceutical package also includes an engagement member configured to engage the card in an instance in which the card is disposed within the housing. For example, the card may define an opening and the engagement member may be configured to extend into the opening defined by the card when the card is in the housing. The pharmaceutical package also includes a twistable actuator configured to disengage the card and the engagement member in response to rotation of the twistable actuator relative to the housing.

8 Claims, 6 Drawing Sheets

(56) References Cited

OTHER PUBLICATIONS

Burgopak compliance packaging: Child Resistant; [Online]; [Retrieved on Feb. 24, 2011]; Retrieved from the Internet <URL: http://www.burgopakhealthcare.com/child__resistant.html>; 2 pages.

Burgopak compliance packaging: Automation; Burgopak packaging production; [Online]; [Retrieved on Feb. 24, 2011]; Retrieved from the Internet <URL: http://www.burgopakhealthcare.com/automation.html>; 2 pages.

MWV: Shellpak® Unit-Dose Medication Packaging; [Online]; [Retrieved on Feb. 23, 2011]; Retrieved from the Internet <URL: http://www.meadwestvaco.com/HealthcarePackagingSolutions/SolidOralDoseandAdherence/MWV021960>; 2 pages.

* cited by examiner

PHARMACEUTICAL PACKAGE HAVING A TWISTABLE ACTUATOR AND ASSOCIATED METHOD OF ACCESSING MEDICATION

TECHNOLOGICAL FIELD

Embodiments of the invention relate generally to pharmaceutical packaging and, more particularly, relate to pharmaceutical packages having a twistable actuator for facilitating access to the medication within the package as well as related methods for accessing medications within a pharmaceutical package.

BACKGROUND

A variety of different pharmaceutical packages have been developed in order to store and control access to medication. For example, blister packaging has been developed in which one or more blisters are carried by a card with each blister housing a predefined quantity of medication, such as a pill, capsule or the like. In order to access the medication, a user may peel back a backing material so as to gain access to the interior of the blister and retrieve the medication. By storing the medication in one or more blisters carried by a card, a visible indication is provided to the user as to the amount of medication that remains available. In some instances, the predefined quantity of medication that is stored in a blister constitutes a unit dose, thereby facilitating administration of a proper dosage.

Pharmaceutical packaging must not only store and control access to medication, but at least some pharmaceutical packaging must also be child resistant in order to reduce the likelihood of inadvertent access of the medication by a child. As such, a pharmaceutical package that includes a card that carries one or more blisters for storing medication may also include a housing within which the card may be disposed. In this regard, the housing may be sized such that the card or at least that portion of the card that carries the blisters with medication therein may be slid into the housing and disposed therewithin such that the medication is not accessible while the card is disposed within the housing. In order to access the medication, the card may be slid or extended from the housing. In order to provide child resistance, the housing may therefore releasably secure the card therewithin such that the card cannot be freely slid or extended from the housing, such as by a child. Instead, the housing may be designed such that a user must squeeze or otherwise apply force to certain predetermined portions of the housing in order to release the card and to permit the card to be extended from the housing in order to access the medication. In one example, the opposite side edges of the housing must be squeezed toward one another in order to release the card.

While effective with respect to increasing the child resistance of the pharmaceutical package, these techniques which rely upon the application of force, such as a squeezing motion, to predefined portions of the housing in order to release the card from the housing, may be difficult not only for children, but also for other users, such as users having arthritis or other limitations upon the mobility of the user's fingers. Indeed, these pharmaceutical packages not only require the application of force, such as a squeezing motion, to predefined portions of the housing that may be spaced fairly widely from one another, such as approximately four inches apart from one another, but also require the user to pull or slide the card from the housing while continuing to apply the force to the predefined portions of the housing.

While the significant amount of coordinated mobility that is required to access the medication within such pharmaceutical packages is helpful in terms of increasing its child resistance, such requirements may also limit or otherwise make it difficult the access to the medication within such pharmaceutical packages by users having arthritis or otherwise having limited mobility with their hands. As such, it may be advantageous to provide an improved pharmaceutical package that continues to be child resistant, while also being more readily accessible to users including, for example, users having arthritis or other conditions that may limit the mobility of their hands.

BRIEF SUMMARY

A pharmaceutical package is therefore provided according to one embodiment of the present invention that is child resistant, but is easier to access for users having arthritis or otherwise having limited mobility in their fingers. In this regard, the pharmaceutical package of one embodiment may include a twistable actuator that may be twisted by a user in order to release a card carrying the medication from the housing. By relying upon a twistable actuator to release the card, a user having arthritis or otherwise having limited mobility in their fingers may more readily and naturally rotate the twistable actuator in order to release the card in comparison to prior pharmaceutical packages that require opposing or other predefined portions of the housing to be squeezed or that required force to otherwise be applied to certain predefined portions of the housing in order to release the card. As such, a pharmaceutical package according to one embodiment may provide for controlled access to the medication including, for example, controlled access by users having arthritis or otherwise having limited mobility in their fingers. A corresponding method of providing controlled access to the medication within a pharmaceutical package is also provided in accordance with another embodiment of the present invention.

A pharmaceutical package is provided according to one embodiment that includes a housing and a card carrying at least one medication that is slidably disposed at least partially within the housing such that the at least one medication carried by the card is positioned within the housing. For example, the card may include a plurality of blisters configured to store respective unit does medications. The pharmaceutical package of this embodiment also includes an engagement member configured to engage the card in an instance in which the card is disposed at least partially within the housing. For example, the card may define an opening and the engagement member may be configured to extend into the opening defined by the card in the instance in which the card is disposed at least partially within the housing. The pharmaceutical package of this embodiment also includes a twistable actuator configured to disengage the card and the engagement member in response to rotation of the twistable actuator relative to the housing. As noted above, the rotation of the twistable actuator may be more readily performed by a user having arthritis or otherwise having more limited mobility in their fingers.

In one embodiment, the engagement member includes a pin. In this embodiment, the twistable actuator may be threadably connected to the pin such that rotation of the twistable actuator retracts the pin from the opening so as to permit the card to be slidably extended from the housing. The twistable actuator of this embodiment may also include a bias member for urging the pin to extend into the opening. In another embodiment, the twistable actuator includes an asymmetrical contact member that is configured to be rotated in response to rotation of the twistable actuator. In this regard, the asymmetrical contact member may be configured to be rotated from a first position in which the engagement member extends into the opening defined by the card to a second position in which the asymmetrical contact member causes the card to be deflected such that the engagement member no longer extends into the opening defined by the card, thereby permitting the card to be slidably extended from the housing. The engagement member of either embodiment may have a tapered surface for facilitating the slidable insertion of the card at least partially within the housing.

In accordance with another embodiment, a pharmaceutical package is provided that includes a housing and a card having a plurality of blisters configured to store respective unit dose medications. The card is slidably disposed at least partially within the housing such that the plurality of blisters carried by the card are positioned within the housing. The card of this embodiment also defines an opening. The pharmaceutical package of this embodiment also includes an engagement member configured to extend into the opening defined by the card in the instance in which the card is disposed at least partially within the housing. The pharmaceutical package also includes a twistable actuator configured to disengage the card and the engagement member in response to rotation of the twistable actuator relative to the housing.

In one embodiment, the engagement member includes a pin. In this embodiment, the twistable actuator may be threadably connected to the pin such that rotation of the twistable actuator retracts the pin from the opening so as to permit the card to be slidably extended from the housing. The twistable actuator of this embodiment may also include a bias member for urging the pin to extend into the opening. In another embodiment, the twistable actuator includes an asymmetrical contact member that is configured to be rotated in response to rotation of the twistable actuator. In this regard, the asymmetrical contact member may be configured to be rotated from a first position in which the engagement member extends into the opening defined by the card to a second position in which the asymmetrical contact member causes the card to be deflected such that the engagement member no longer extends into the opening defined by the card, thereby permitting the card to be slidably extended from the housing. The engagement member of either embodiment may have a tapered surface for facilitating the slidable insertion of the card at least partially within the housing.

In a further embodiment, a method for accessing a medication within a pharmaceutical package is provided. The method includes providing the pharmaceutical package having a housing, a card carrying at least one medication that is disposed at least partially within the housing, and an engagement member that engages the card in an instance in which the card is disposed at least partially within the housing. In one embodiment, the card may include a plurality of blisters configured to store respective unit dose medications. The method also includes rotating a twistable actuator relative to the housing so as to disengage the card and the engagement member and slidably extending the card from the housing so as to permit access to the at least one medication carried by the card.

In one embodiment, the provision of the pharmaceutical package includes providing the card that defines an opening and the engagement member that extends into the opening defined by the card in the instance in which the card is disposed at least partially within the housing. In this embodiment, the engagement member may include a pin and the twistable actuator may be threadably connected to the pin such that rotating the twistable actuator comprises retracting the pin from the opening in the card so as to permit the card to be slidably extended from the housing. The method of this embodiment may also include urging the pin to extend into the opening, such as in an instance in which the twistable actuator has not been rotated. In another embodiment, the twistable actuator includes an asymmetrical contact member. In this embodiment, the rotating of the twistable actuator includes rotating the asymmetrical contact member from the first position in which the engagement member extends into the opening defined by the card to a second position in which the asymmetrical contact member causes the card to be deflected such that the engagement member no longer extends into the opening defined by the card, thereby permitting the card to be slidably extended from the housing. In one embodiment in which the engagement member has a tapered surface, the method also includes inserting the card at least partially within the housing at the tapered surface of the engagement member serving to guide the engagement member into the opening defined by the card.

By requiring a user to rotate a twistable actuator in order to release the card from the housing so as to access the medication carried by the card, a user having arthritis or otherwise having somewhat limited mobility in their fingers may more readily provide the required rotation and access the medication than pharmaceutical packages that rely upon the application of force, such as by a squeezing motion, applied to opposite edges or to other predefined portions of a housing. Thus a pharmaceutical package in accordance with embodiments of the present invention may be more user-friendly for users having arthritis or otherwise having somewhat limited mobility in their fingers, while still providing child resistance.

BRIEF DESCRIPTION OF SEVERAL VIEWS OF THE DRAWINGS

Figure 1:
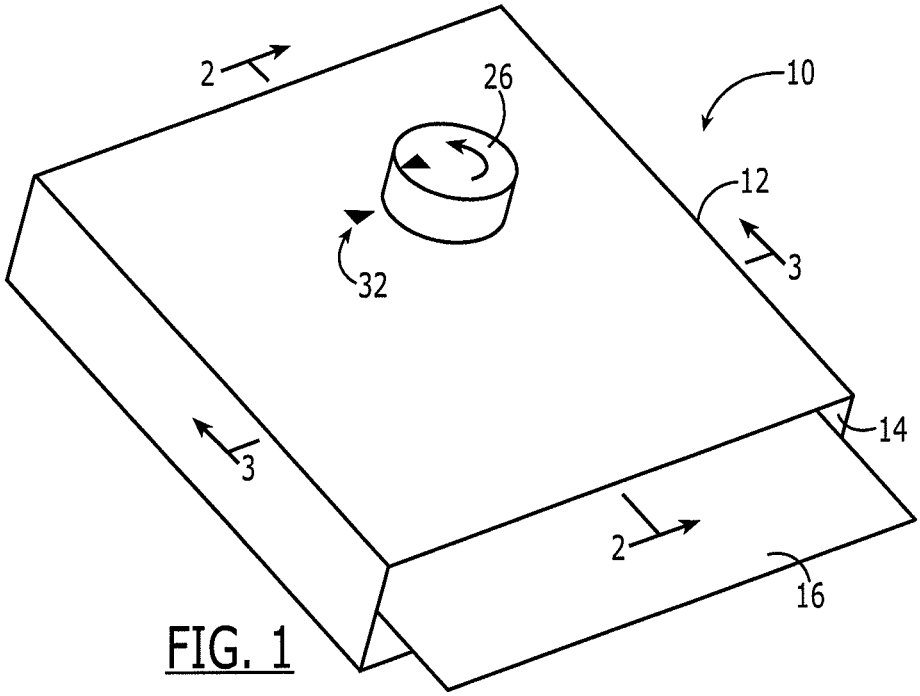
Figure 2:
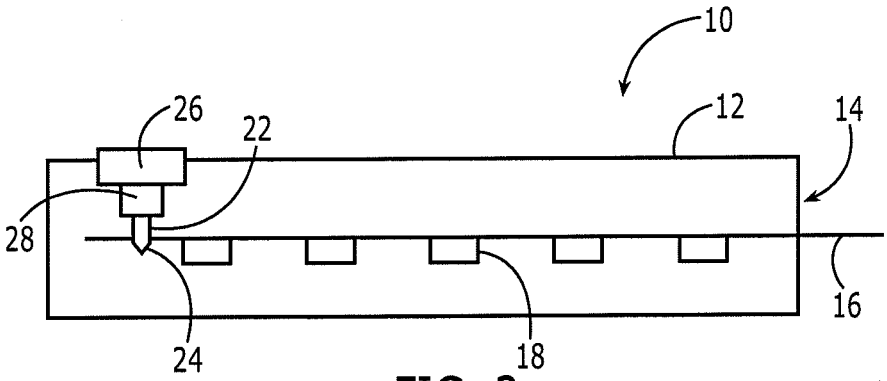
Figure 3:
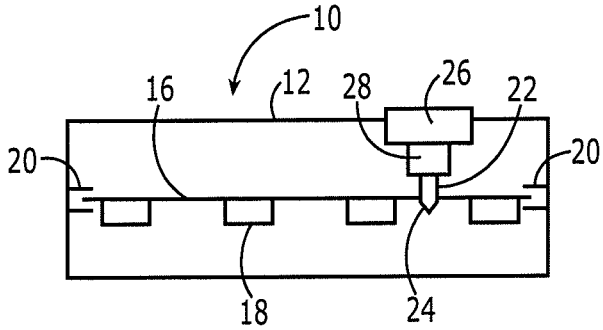
Figure 4:
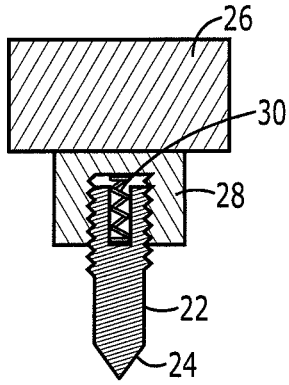
Figure 5:
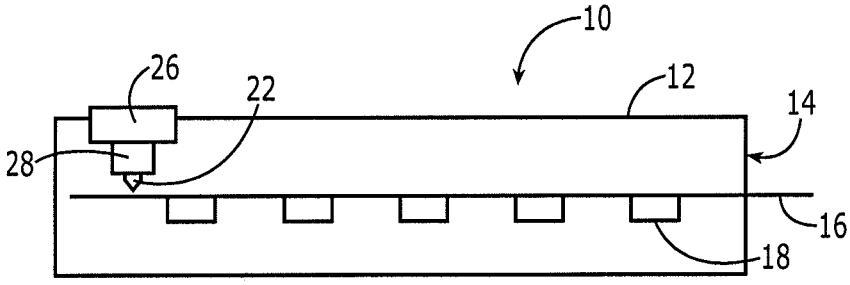
Figure 6:
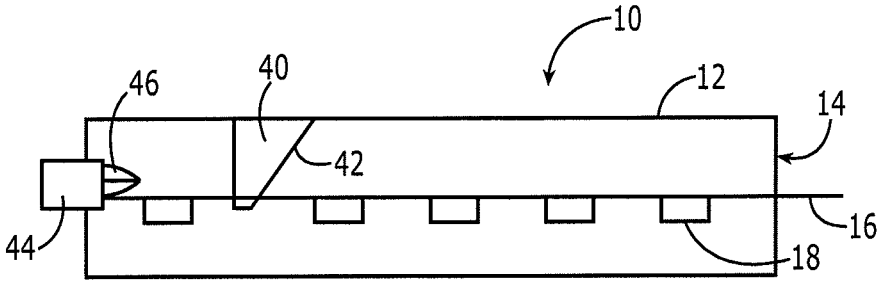
Figure 7:
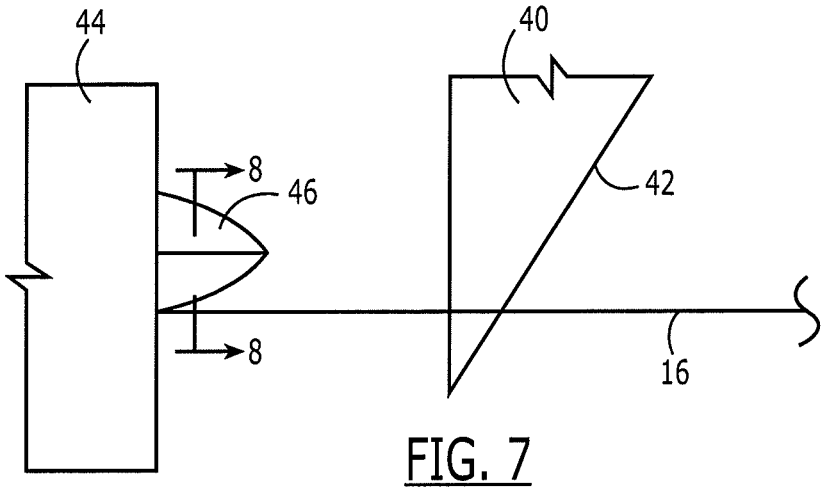
Figure 8:
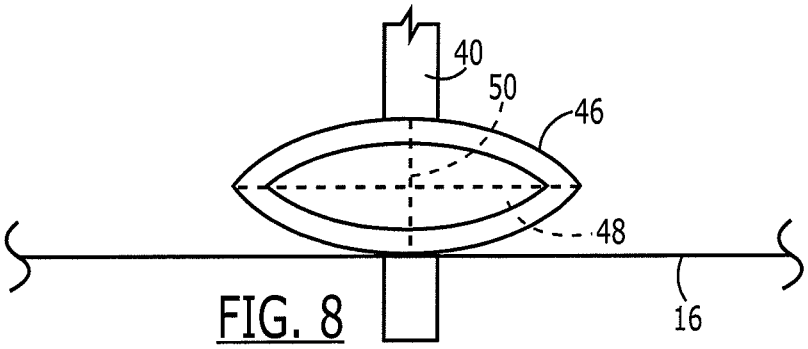
Figure 9:
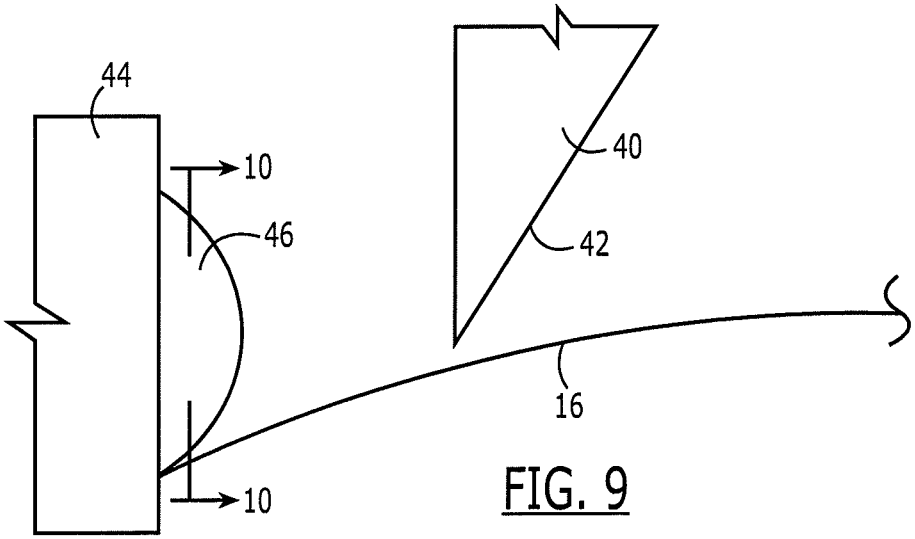
Figure 10:
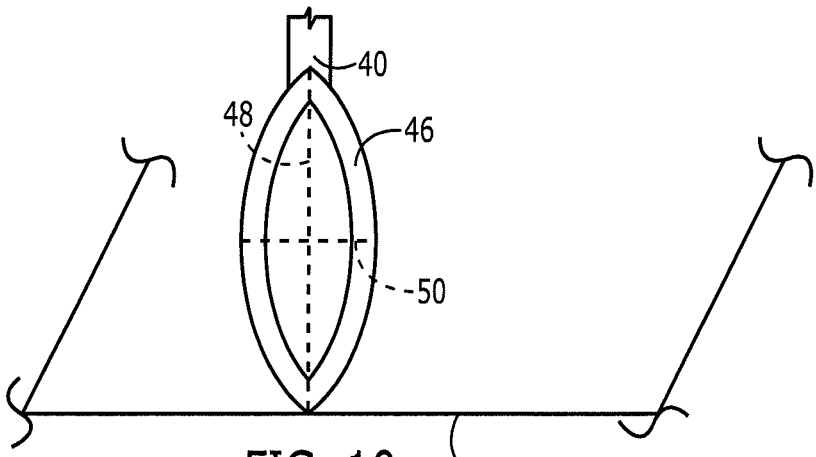
Figure 11:
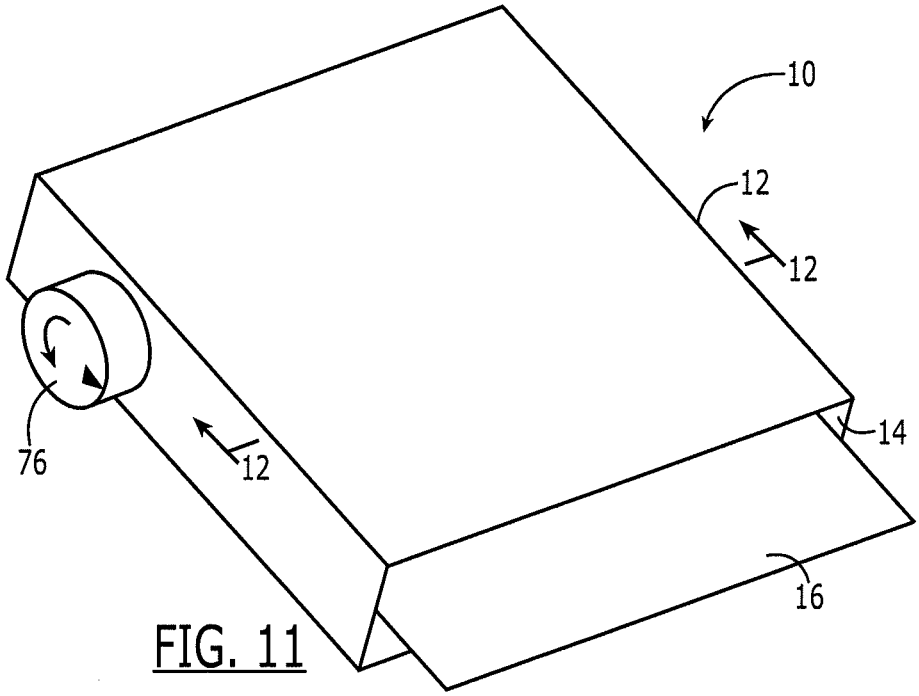
Figure 12:
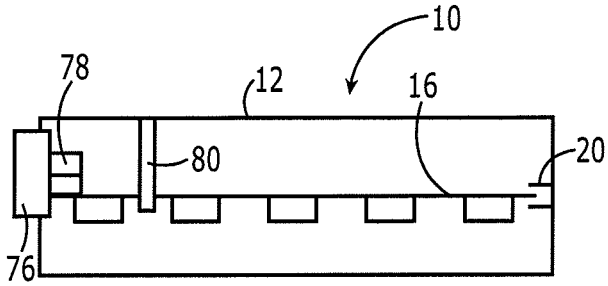
Figure 13:
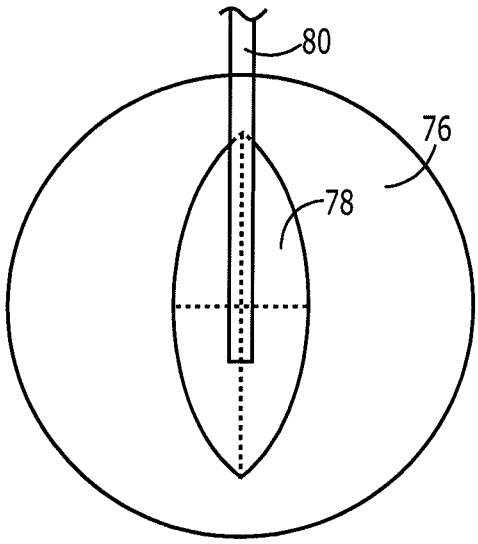
Figure 14:
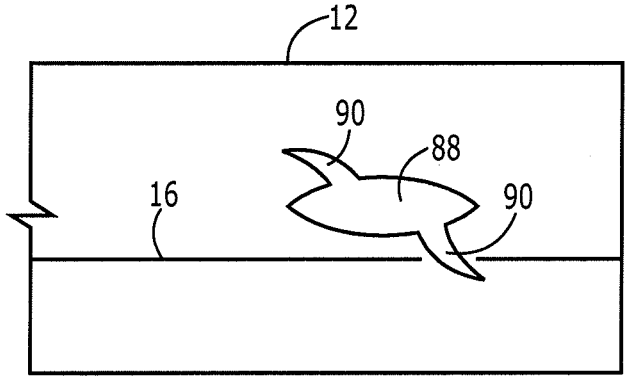
Figure 15:
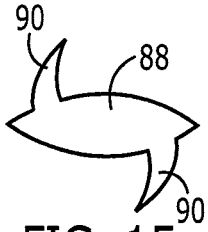
Figure 16:
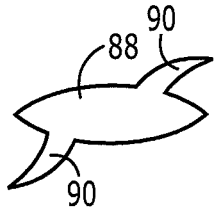
Figure 17:
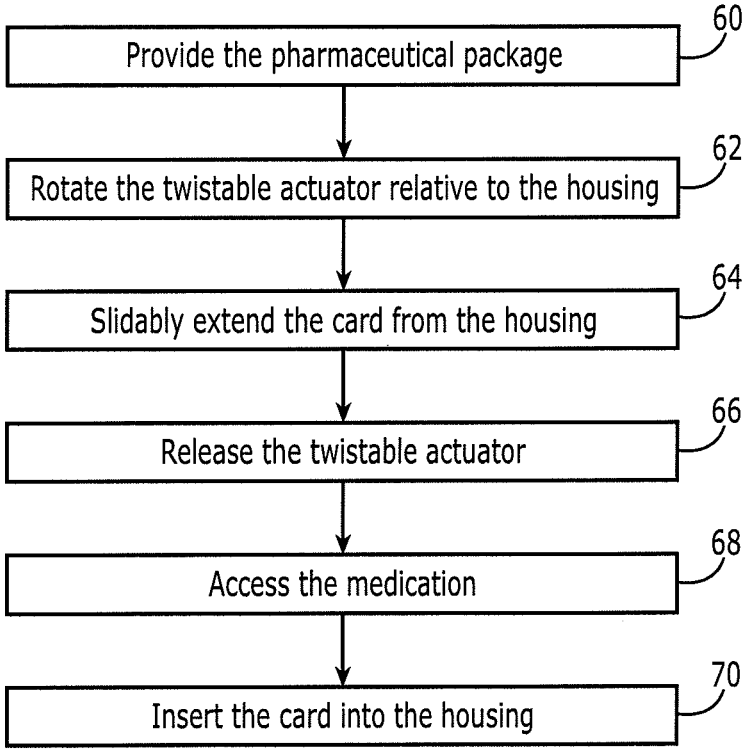

Having thus described embodiments of the invention in general terms, reference will now be made to the accompanying drawings, which are not necessarily drawn to scale, and wherein:

FIG. 1 is a perspective view of a pharmaceutical package in accordance with one embodiment of the present invention;

FIG. 2 is a side view of the pharmaceutical package of FIG. 1 taken along line 2-2 of FIG. 1 in which the pin is extended through an opening defined by the card in order to secure the card at least partially within the housing;

FIG. 3 is an end view of the pharmaceutical package of FIG. 1 taken along line 3-3 of FIG. 1 in which the pin is extended through an opening defined by the card in order to secure the card at least partially within the housing;

FIG. 4 is a cross-sectional view of the twistable actuator and associated engagement member of the pharmaceutical package of FIG. 1;

FIG. 5 is a side view of the pharmaceutical package of FIG. 1 taken along line 2-2 of FIG. 1 in which the pin has been retracted and no longer extends through the opening defined by the card in order to permit the card to be extended from the housing;

FIG. 6 is a side view of the pharmaceutical package of another embodiment of the present invention having a twistable actuator with an asymmetrical contact member;

FIG. 7 is a more detailed side view of the pharmaceutical package of FIG. 6 illustrating the asymmetrical contact member in a first position with the engagement member extending through an opening defined by the card in order to secure the card at least partially within the housing;

FIG. 8 is a cross-sectional end view of the asymmetrical contact member in the first position and the engagement member taken along line 8-8 of FIG. 7;

FIG. 9 is a more detailed side view of the pharmaceutical package of FIG. 6 illustrating the asymmetrical contact member in a second position that causes the card to be deflected such that the engagement member no longer extends through an opening defined by the card and the card may be extended from the housing;

FIG. 10 is a cross-sectional end view of the asymmetrical contact member in the second position and the engagement member taken along line 10-10 of FIG. 9;

FIGS. 11-16 illustrate a pharmaceutical package in accordance with a further embodiment of the present invention;

FIG. 17 is a flow chart illustrating operations performed in accordance with the method for accessing a medication within a pharmaceutical package in accordance with one embodiment of the present invention.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, a pharmaceutical package 10 in accordance with one embodiment of the present invention is illustrated. The pharmaceutical package 10 includes a housing 12 that serves to protect the medication and to prevent access to the medication while the medication is disposed within the housing. The housing 12 may be formed of various materials, but is formed of a laminated cardboard in one embodiment. In the embodiment of FIG. 1, the housing 12 has a rectangular solid shape that is open on one end 14. However, the housing 12 may have other shapes, if so desired. Although not shown in FIG. 1, the housing 12 may include indicia that identifies the medication, the manufacturer and the like and that provides the list of ingredients, the dosage instructions and various warnings and other information.

As shown in more detail in the side view of FIG. 2, the pharmaceutical package 10 also includes a card 16 that carries at least one medication. The card 16 is slidably disposed at least partially within the housing 12 such that the medication carried by the card is positioned within the housing. As shown in FIG. 3, the housing 12 may define tracks or slots 20 along the opposed sidewalls that engage opposite side edges of the card 16 in order to position the card within the housing such that the medication is spaced at least somewhat from the walls of the housing and to facilitate the slidable insertion and extension of the card relative to the housing. The card 16 may be sized such that one end of the card protrudes beyond the open end 14 of the housing 12 even in an instance in which the card has been fully inserted into the housing. By extending beyond the housing 12, the end portion of the card 16 permits a user to grasp the card in order to slide the card outward from the housing once the card has been released from the housing. The end portion of the card 16 that protrudes beyond the housing 12 generally does not carry any medication such that all of the medication carried by the card is disposed within the housing once the card has been inserted into the housing.

The pharmaceutical package 10 may include a variety of cards 16 that carry medication. In one embodiment, however, the card 16 is a blister card that includes a plurality of blisters 18 configured to store respective medications, such as pills, capsules or the like. For example, each blister 18 may store a unit dose of the medication to facilitate the administration of a proper dosage. Once the card 16 is extended from the housing 12, a user may access the medication within a blister 18 by pealing back the backing material that otherwise covers the blister and then extracting the medication from the blister.

The pharmaceutical package 10 also includes an engagement member configured to engage the card 16 in an instance in which the card is disposed at least partially within the housing 12. In the embodiment of FIGS. 2 and 3, the engagement member is a pin 22 that extends into the cavity defined by the housing 12 and engages the card 16. In this embodiment, the card 16 defines an opening and the pin 22 is carried by the housing 12 in a position that is aligned with the opening defined by the card once the card is fully inserted within the housing such that only the end portion of the card extends from the housing. While the pin 22 extends through the opening defined by the card 16, a user is unable to extend the card from the housing 12 so as to access the medication, thereby securely retaining the medication within the housing and providing child resistance properties. In order to provide controlled access to the medication carried by the card 16, however, the pharmaceutical package 10 of this embodiment also includes a twistable actuator 26. In the embodiment of FIGS. 1-3, the twistable actuator 26 includes a knob that is mounted to or carried by the housing 12 and is configured to be rotated relative to the housing.

As shown in FIG. 4, the twistable actuator 26 is operably engaged to the engagement member such that rotation of the twistable actuator causes the card 16 and the engagement member to be disengaged, such as by withdrawing the pin 22 from the opening defined by the card, thereby permitting subsequent extension of the card from the housing 12 and access to the medication carried by the card. While the twistable actuator 26 may operably engage the engagement member in various manners, the twistable actuator of the embodiment depicted in FIG. 4 threadably engages the pin 22. In this regard, the twistable actuator 26 may include an internally threaded portion 28 that opens into the interior of the cavity defined by the housing 12. Correspondingly, a rear portion of the pin 22 may be externally threaded and configured to be threadably engaged by the internally threaded portion of the twistable actuator. Although not illustrated, the pin 22 and the twistable actuator 26, such as the internally threaded portion 28 of the twistable actuator, may include cooperating features to prevent the pin from being inadvertently disengaged from the twistable actuator.

In the embodiment illustrated in FIGS. 2 and 3, the pin 22 may be extended such that there is only a limited threaded engagement between the pin and the twistable actuator 26. As such, the pin 22 extends from the twistable actuator 26 and through the opening defined by the card 16, thereby retaining the card within the housing 12. In order to extend the card 16 from the housing 12, a user may rotate the twistable actuator 26. This rotation of the twistable actuator 26 causes the further threaded engagement of the pin 22 with the twistable actuator 26 with the threaded end portion of the pin being threadably advanced further into the internally threaded portion 28 of the twistable actuator, thereby reducing the length of the pin that extends from the twistable actuator. In one embodiment, for example, the opening defined by the card 16 and the pin 22 may be sized and shaped such that the pin frictionally engages edges of the opening defined by the card. In response to rotation of the twistable actuator 26, the pin 22 may therefore be prevented or at least discouraged from rotating by the frictional engagement with the card 16 such that the pin is further threadably engaged by and drawn into the internally threaded portion 28 of the twistable actuator. The pin 22 may therefore be withdrawn from the opening defined by the card 16 as shown in FIG. 5 such that the card may then be extended from the housing 12 and medication may be accessed.

Once the card 16 has been extended, the twistable actuator 26 may be released so as to return to its initial position, such as indicated by the alignment of the reference marks 32 on a surface of the housing 12. The twistable actuator 26 of one embodiment includes a bias member 30, such as a spring, disposed between the knob of the twistable actuator and the pin 22. For example, the rear portion of the pin 22 may define an internal opening within which a spring may be seated. Upon release of the twistable actuator 26 and the return of the twistable actuator to its initial position, the bias member 30 may exert a force upon the pin 22 so as to cause the pin to be at least partially de-threaded from the internally threaded portion 28 of the twistable actuator and to resume its rest position in which the pin extends further from the twistable actuator, as shown in FIGS. 2 and 3. As noted above, the pin 22 and/or the twistable actuator 26, such as the internally threaded portion 28 of the twistable actuator, may include features to retain the pin within the internally threaded portion of the twistable actuator and to prevent the pin from being completely de-threaded therefrom as the bias member 30 causes the pin to again be extended.

The pin 22 may include a tapered distal end 24 to facilitate the insertion of the card 16 at least partially within the housing 12. In this regard, the distal end of the pin 22 may have a tapered surface 24 that is oriented so as to face the open end 14 of the housing 12. As such, the insertion of the card 16 within the housing 12, such as following a user's access of a unit dose medication, will cause one end of the card to contact the tapered surface 24. As a result of the tapered surface 24, the card 16 will be deflected and will move somewhat beyond the pin 22. Once fully inserted, the opening defined by the card 16 will be aligned with the pin 22 such that the pin extends through the opening and again retains the card within the housing 12.

As described above, the pharmaceutical package 10 of this embodiment permits a user to extend the card 16 from the housing 12 and to access the medication by rotating the twistable actuator 26 and pulling the card at least partially from the housing. These motions may be more readily performed by users, including users having arthritis or otherwise having somewhat limited mobility in their fingers, in comparison to other pharmaceutical packages that may require force to be applied to predefined portions of the package, such as by means of a squeezing motion, in order to release the card. Thus, the pharmaceutical package 10 of this embodiment facilitates the controlled access to the medication by users having limited mobility while still providing child resistance.

The pharmaceutical package 10 may be embodied in various manners and, in one embodiment, may include other types of twistable actuators and engagement members. As shown in FIG. 6, for example, the pharmaceutical package 10 of another embodiment includes an engagement member 40 that extends from the housing 12 and engages the card 16. For example, the card 16 may define an opening that is in alignment with the engagement member 40 once the card is fully inserted within the housing 12. As shown in FIGS. 6 and 7, the engagement member 40 may extend through the opening so as to retain the card 16 within the housing 12. The twistable actuator 44 of this embodiment is not operably connected to the engagement member 40 since the engagement member is fixed in relation to the housing 12. Instead, the twistable actuator 44 includes an asymmetric contact member 46 configured to contact the card 16, such as one end of the card. The asymmetric contact member 46 may have various shapes, but generally has a long dimension 48 and a short dimension 50. In the illustrated embodiment, the long dimension 48 and the short dimension 50 are offset by 90° from one another. However, the long dimension 48 and the short dimension 50 may be angularly spaced by another amount, if so desired. In an instance in which the long dimension 48 is generally parallel to the card 16 and the short dimension 50 is oriented generally perpendicular to the card, the asymmetric contact member 46 may either be spaced from the card or only lightly touch the card so as to only minimally deflect the card, if at all. As such, in this situation as shown in FIGS. 7 and 8, the engagement member 40 extends through the opening defined by the card 16 and engages the card, thereby maintaining the card within the housing 12.

Since the asymmetric contact member 46 is configured to rotate with the knob of the twistable actuator 44, rotation of the twistable actuator similarly causes rotation of the asymmetric contact member. By rotating the asymmetric contact member 46 such that the long dimension 48 is now oriented so as to be perpendicular to the card 16 and the short dimension 50 is oriented so as to be parallel to the card as shown in FIGS. 9 and 10, the asymmetric contact member will contact the card, such as the end of the card, and cause the card to be deflected. In this regard, the difference in length between the short dimension 50 and the long dimension 48 is sufficient that the deflection of the card 16 created by the asymmetric contact member 46 causes the card to be deflected to such a degree that the engagement member 40 no longer extends through the opening defined by the card. Thus, the card 16 may be pulled from the housing 12 in order to access the medication carried by the card. In order to reinsert the card 16, the twistable actuator 44 may be returned to its initial position in which the long dimension 48 is oriented parallel to the card and the short dimension 50 is oriented perpendicular to the card. The card 16 may then be inserted into the housing 12. As described above, the engagement member 40 may include a tapered surface 42 that faces the open end 14 of the housing 12. As such, the end of the card 16 may contact the tapered surface 42 and be slightly deflected while being further advanced into the housing 12. Once fully inserted into the housing 12, the opening defined by the card 16 is again aligned with the engagement member 40 such that the engagement member extends through the opening and retains the card within the housing 12.

FIGS. 11-16 illustrate a pharmaceutical package in accordance with another embodiment of the present invention.

As shown in FIG. 17, a method for accessing a medication within a pharmaceutical package 10 is also provided in accordance with one embodiment. In this embodiment, a pharmaceutical package may be provided that includes a housing 12, a card 16 carrying at least one medication that is disposed at least partially within the housing, an engagement member 22, 40, 80, 90 that engages the card in an instance in which the card is disposed at least partially within the housing and a twistable actuator 26, 44, 76. See operation 60. In order to access the card 16 and the medication carried by the card, the twistable actuator 26, 44, 76 may be rotated relative to the housing 12, as shown in operation 62. As described above, this rotation of the twistable actuator 26, 44, 76 disengages the card 16 from the engagement member 22, 40, 80, 90. As such, the card 16 may be slidably extended from the housing 12 so as to permit access to at least one medication carried by the card. See operation 64. Once the card 16 has been slidably extended from the housing 12, the twistable actuator 26, 44, 76 may be released and returned to its initial position. See operation 66. Once the medication has been accessed, the card 16 may be reinserted at least partially within the housing 12, as shown in operations 68 and 70. In this regard, the engagement member 22, 40, 80, 90 may include a tapered surface 24, 42 that serves to guide the engagement member into the opening defined by the card 16, thereby again engaging the card and preventing extension of the card and the medication carried by the card from the housing 12 until the user again rotates the twistable actuator 26, 44, 76 and repeats the process of FIG. 17.

This process of securing the card 16 within the housing 12, controllably releasing the card in order to extend the card from the housing and access the medication and then reinserting and re-engaging the card within the housing can be repeated a number of times in order to access different medications carried by the card over the course of time. In each instance, the requirement that the twistable actuator 26, 44 be rotated and the card 16 be pulled from the housing 12 provides child resistance, while permitting a user having arthritis or otherwise having limited mobility in their fingers to more readily access the medication otherwise stored within the housing.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A pharmaceutical package comprising:

a housing;

a card defining an opening and carrying at least one medication, wherein the card is slidably disposed at least partially within the housing such that the at least one medication carried by the card is positioned within the housing;

an engagement member configured to engage the card by extending into the opening in an instance in which the card is disposed at least partially within the housing; and a twistable actuator defining an axis of rotation extending through a central portion of the twistable actuator and spaced apart from the housing, the twistable actuator configured to disengage the card and the engagement member in response to rotation of the twistable actuator relative to both the housing and the card and about the axis of rotation defined thereby, wherein the twistable actuator comprises a contact member configured to be rotated in response to rotation of the twistable actuator from a first position in which the engagement member extends into the opening defined by the card to a second position in which the contact member causes the card to be deflected such that the engagement member no longer extends into the opening defined by the card so as to permit the card to be slidably extended from the housing.

2. A pharmaceutical package according to claim 1 wherein the engagement member has a tapered surface for facilitating slidable insertion of the card at least partially within the housing.

3. A pharmaceutical package according to claim 1 wherein the card comprises a plurality of blisters configured to store respective unit dose medications.

4. A pharmaceutical package comprising:

a housing;

a card comprising a plurality of blisters configured to store respective unit dose medications, wherein the card is slidably disposed at least partially within the housing such that the plurality of blisters carried by the card are positioned within the housing, and wherein the card defines an opening;

an engagement member configured to extend into the opening defined by the card in the instance in which the card is disposed at least partially within the housing; and a twistable actuator defining an axis of rotation extending through a central portion of the twistable actuator and spaced apart from the housing, the twistable actuator configured to disengage the card and the engagement member in response to rotation of the twistable actuator relative to both the housing and the card and about the axis of rotation defined thereby, wherein the twistable actuator comprises a contact member configured to be rotated in response to rotation of the twistable actuator from a first position in which the engagement member extends into the opening defined by the card to a second position in which the contact member causes the card to be deflected such that the engagement member no longer extends into the opening defined by the card so as to permit the card to be slidably extended from the housing.

5. A pharmaceutical package according to claim 4 wherein the engagement member has a tapered surface for facilitating slidable insertion of the card at least partially within the housing.

6. A method for accessing a medication within a pharmaceutical package, the method comprising:

providing the pharmaceutical package comprising a housing, a card defining an opening and carrying at least one medication that is disposed at least partially within the housing, an engagement member that engages the card by extending into the opening in an instance in which the card is disposed at least partially within the housing, and a twistable actuator;

rotating the twistable actuator relative to the housing so as to disengage the card and the engagement member, wherein rotating the twistable actuator comprises rotating the twistable actuator about an axis of rotation that is defined by the twistable actuator so as to extend through a central portion of the twistable actuator and to be spaced apart from the housing, and wherein rotating the twistable actuator further comprises rotating the twistable actuator relative to both the housing and the card and about the axis of rotation defined thereby; and wherein the twistable actuator comprises a contact member, and wherein rotating the twistable actuator comprises rotating the contact member from a first position in which the engagement member extends into the opening defined by the card to a second position in which the contact member causes the card to be deflected such that the engagement member no longer extends into the opening defined by the card so as to permit the card to be slidable extended from the housing;

and slidably extending the card from the housing so as to permit access to the at least one medication carried by the card.

7. A method according to claim 6 wherein the engagement member has a tapered surface, and wherein the method further comprises inserting the card at least partially within the housing with the tapered surface of the engagement member serving to guide the engagement member into the opening defined by the card.

8. A method according to claim 6 wherein providing the pharmaceutical package comprises providing the card comprising a plurality of blisters configured to store respective unit dose medications.

* * * * *

UNITED STATES PATENT AND TRADEMARK OFFICE

CERTIFICATE OF CORRECTION

PATENT NO. : 8,662,304 B2
APPLICATION NO. : 12/953515
DATED : March 4, 2014
INVENTOR(S) : Myszak It is certified that error appears in the above-identified patent and that said Letters Patent is hereby corrected as shown below:

In the Claims

Column 10, Claim 6,
Line 62, "slidable extended" should read --slidably extended--.

Signed and Sealed this
Twenty-fourth Day of June, 2014

Michelle K. Lee

Michelle K. Lee
*Deputy Director of the United States Patent and Trademark Office*